US005087499A

United States Patent [19]

Sullivan

[11] Patent Number: 5,087,499

[45] Date of Patent: Feb. 11, 1992

[54] PUNCTURE-RESISTANT AND MEDICINAL TREATMENT GARMENTS AND METHOD OF MANUFACTURE THEREOF

[76] Inventor: Thomas M. Sullivan, P.O. Box 4615, San Diego, Calif. 92104

[21] Appl. No.: 520,815

[22] Filed: May 9, 1990

[51] Int. Cl.[5] ..... A41D 13/10; B32B 5/14; B32B 33/00; D02G 3/34; D02G 3/44; D06C 11/00

[52] U.S. Cl. ..... 428/85; 2/21; 2/161 R; 2/163; 2/167; 2/169; 2/DIG. 7; 5/495; 28/159; 28/165; 28/166; 28/167; 28/219; 28/220; 57/252; 57/253; 57/255; 57/257; 57/258; 66/202; 128/114.1; 128/849; 139/420 A; 424/402; 424/404; 424/409; 424/446; 424/447; 427/389.9; 428/96; 428/97; 428/229; 428/241; 428/254; 428/264; 428/265; 514/887; 602/44

[58] Field of Search ..... 2/21, 161 R, 163, 167, 2/169, DIG. 7; 28/159, 165, 166, 167, 219, 220; 57/252, 253, 255, 257, 258; 424/402, 404, 409, 446, 447; 5/495, DIG. 1; 128/114.1, 156, 849; 427/389.9; 428/229, 241, 254, 264, 265, 87, 96, 97, 85

[56] References Cited

U.S. PATENT DOCUMENTS

| | | | |
|---|---|---|---|
| 4,499,154 | 2/1985 | James et al. | 2/DIG. 7 |
| 4,526,828 | 7/1985 | Fogt et al. | 2/21 |
| 4,901,372 | 2/1990 | Pilace | 2/21 |

*Primary Examiner*—James C. Cannon
*Attorney, Agent, or Firm*—H. Jay Spiegel

[57] ABSTRACT

The present invention relates to improvements in puncture-resistant and medicinal treatment garments. Garments made from fibers such as KEVLAR® and designed to deter penetration of objects are subjected to an additional brushing step to enhance the fibers' abilities to prevent penetration of sharp needle-like penetrating objects. The fibers may also be coated with an abrasive material to further engage and deflect penetrating objects. In another aspect of the invention, the fibers may be coated with a disinfectant or pharmaceutical agent. The coated fibers, having the improved fiber structure resulting from the brushing step, may be used in fabrics to treat skin conditions, disinfect penetrating objects in puncture-resistant materials, or as a disinfecting prevention fabric for use in textiles in high risk infection areas such as hospitals and public facilities.

32 Claims, 2 Drawing Sheets

PUNCTURE-RESISTANT AND MEDICINAL TREATMENT GARMENTS AND METHOD OF MANUFACTURE THEREOF

BACKGROUND OF THE INVENTION

The present invention relates to improvements in puncture-resistant garments and the methods of manufacturing thereof. In the prior art, garments made from synthetic fibers and yarns for use in bullet-resistant vests, body armor and butcher's aprons are known. Examples of these types of fibers are KEVLAR®, a polyaramid and SPECTRA®, a high molecular weight polyethylene. These types of fibers, which generally have tensile strength in excess of 300,000 psi, are capable of resisting penetration or puncturing of a garment by absorbing energy as the penetrating object contacts and deflects the fibers. When these types of fibers are tightly woven, large amounts of energy are absorbed by each individual fiber deflecting around the penetrating object and absorbing its share of energy.

The following prior art, which is related to these types of puncture-resistant materials, is known to Applicant:

U.S. Pat. No. 4,526,828 to Fogt, et al. discloses a protective material which includes a cut-resistant material having intermeshing strands defining pores therebetween.

U.S. Pat. No. 4,858,245 to Sullivan, et al. discloses an armored glove finger which may be utilized in conjunction with a surgeon's rubber glove and is made from a cut-resistant fabric.

A need has developed to provide an improved puncture-resistant garment for applications involving sharp penetrating objects. If a penetrating object has a large cross-sectional area perpendicular to the fiber area, its kinetic energy is distributed over a large area and a large number of fibers are available to absorb the kinetic energy and resist penetration. Alternatively, if the penetrating object has a small cross-sectional area perpendicular to the fiber axis, the kinetic energy of the penetrating object is distributed over a small area and only a few fibers are available to absorb the energy. For example, bullets having a relatively large cross-sectional area can be effectively resisted by body armor or the like made of these energy-absorbing fibers. However, ice picks and needles, with small cross-sectional areas, do not engage many fibers on contact and cannot be effectively resisted by these types of body armor garments. Furthermore, these sharp penetrating objects, such as needles, may carry infectious diseases which present an even greater risk to an individual being punctured by such a needle. In response to this need, Applicant has developed a method of manufacturing an improved puncture-resistant garment which provides puncture resistance against sharp penetrating objects. The inventive method includes the step of brushing the fiber that is to be used to produce the puncture-resistant garment or article to provide an improved fiber structure which more effectively resists penetration by sharp objects. Applicant has also discovered that the improved fiber structure may be used in a treating manner by including a coating of a disinfecting or pharmaceutical agent thereon. The improved coated fiber structure may then be utilized to disinfect as well as to stop the penetration of a sharp penetrating object or provide increased contact between the pharmaceutical agent coated onto the fiber structure and an adjacent surface such as a person's skin.

Applicant is unaware of any prior art, including the above-identified U.S. Patents, that includes all of the features of the present invention including the step of brushing a fiber to provide an improved fiber structure in a puncture-resistant garment that enhances engagement of sharp penetrating objects and provides resistance to penetration therethrough.

SUMMARY OF THE INVENTION

The present invention relates to improvements in puncture-resistant garments. The improvements include methods of making puncture-resistant garments, an improved fiber structure as well as the improved fiber structure containing therein disinfecting and pharmaceutical treating agents. The present invention includes the following interrelated aspects and features:

(a) In a first aspect, the ability of puncture-resistant garments to prevent the penetration of sharp needle-like objects is enhanced by the addition of a brushing step in the conventional method of making these types of garments. Fibers such as KEVLAR® or SPECTRA® that are used in puncture-resistant applications are processed into a staple yarn which comprises a plurality of individual fibrils. The staple yarn is then brushed lightly so as to loosen the ends of the individual fibrils along the length of the continuous strand of staple yarn. The brushing step may be done either before or after the yarn is knit or woven into a particular garment. The brushing step, by loosening the ends of the individual fibrils in the staple yarn, provides an improved fiber structure with an increased surface area available for the fibrils to engage the surface of a sharp penetrating object.

(b) The brushed fibril ends may also be subjected to a high-pressure water stream that intertwines the loosened ends and further enhances the penetration-resistant characteristics of the brushed staple yarn.

(c) In a further aspect of the present invention, the fibers which are used to make the staple yarn may be coated with an abrasive material to further enhance the penetration-resistant features of a garment made therefrom. The abrasive material may be coated onto a fiber or filament prior to the yarnmaking step as a mixture of a ceramic or metallic particle and a polymeric resin. After the coated fibers are processed into a yarn and/or a garment, the abrasive coating further engages a sharp penetrating object against the fibrils to effectively further transmit the energy of the penetrating object to the individual fibrils and prevent penetration thereof. Alternatively, the fibers, prior to being processed into a yarn, may be coated with a hard high modulus of elasticity polymer which, when coming in contact with a sharp object, will distribute the instantaneous stress therefrom over a large area of the fibrils and resist penetration therethrough.

(d) In a yet further aspect of the present invention, the fibrils which constitute the staple yarn used to produce these types of puncture-resistant garments may be mixed with a high modulus of elasticity fiber, such as graphite or the like. The presence of a high modulus fiber in combination with the typical fibers used in puncture-resistant garments further enhances the transfer of the penetrating object load throughout the individual fibrils.

(e) In a further aspect of the present invention, Applicant has discovered that fibers such as nylon, cotton, polyester, polyethylene, fiberglass or polyaramids made in accordance with the inventive process may also be coated with a disinfecting or pharmaceutical agent. A pharmaceutical-coated fiber may be used as a treatment material for skin conditions. Additionally, a disinfectant-coated fiber may be used in the manufacture of puncture-resistant gloves or the like, wherein the disinfectant on the surface of the engaging fibers may disinfect a penetrating needle or the like. Furthermore, these types of coated fibers may be woven into textiles such as pillows, sheets, or the like in accordance with the inventive process for application where a risk of infection by individuals coming in contact with these types of textiles is high, such as hospitals, public facilities, emergency medical equipment and the like.

Accordingly, it is a first object of the present invention to provide an improved method for making puncture-resistant garments.

It is a further object of the present invention to provide a method of making puncture-resistant garments which includes the step of brushing a staple yarn to provide an improved fiber structure which increases the engagement of the fiber therein with a contacting surface.

It is a yet further object of the present invention to provide an improved fiber structure which includes an abrasive coating thereon to further enhance the puncture-resistant qualities of the structure.

It is a yet still further object of the present invention to provide the improved fiber structure of the inventive process with a disinfecting or pharmaceutical treating agent thereon.

It is yet a further object of the present invention to provide an improved fiber structure which includes a combination of an ultra-high modulus fiber with a high modulus fiber to enhance the puncture-resistant qualities thereof.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

The present invention provides improvements in the art of puncture-resistant garments and the method of making these types of garments. The inventive method may use any known fibers that have puncture-resisting characteristics. Examples of these types of fibers are polyaramids, polyethylene, polypropylene, scleroproteins (silks), cotton, fiberglass, nylon, polyurethane, and combinations thereof. In the prior art, the process of producing puncture-resistant garments utilizing these types of fibers includes providing a continuous filament of a selected fiber and chopping the filament into individual fibrils. The individual fibrils are then carded into a staple yarn. The staple yarn may then be coated with a finish such as an olefin or the like to enhance a subsequent knitting or weaving step. The finish may then be removed after the knitting step is completed. The garment may then be dried to produce a final product.

Applicant has discovered that the puncture-resistance of garments may be enhanced by including a brushing step in the overall method of making the puncture-resisting garment. The brushing step may be performed either after the yarn has been made or after the yarn has been woven or knit into a particular garment.

Figure 1:
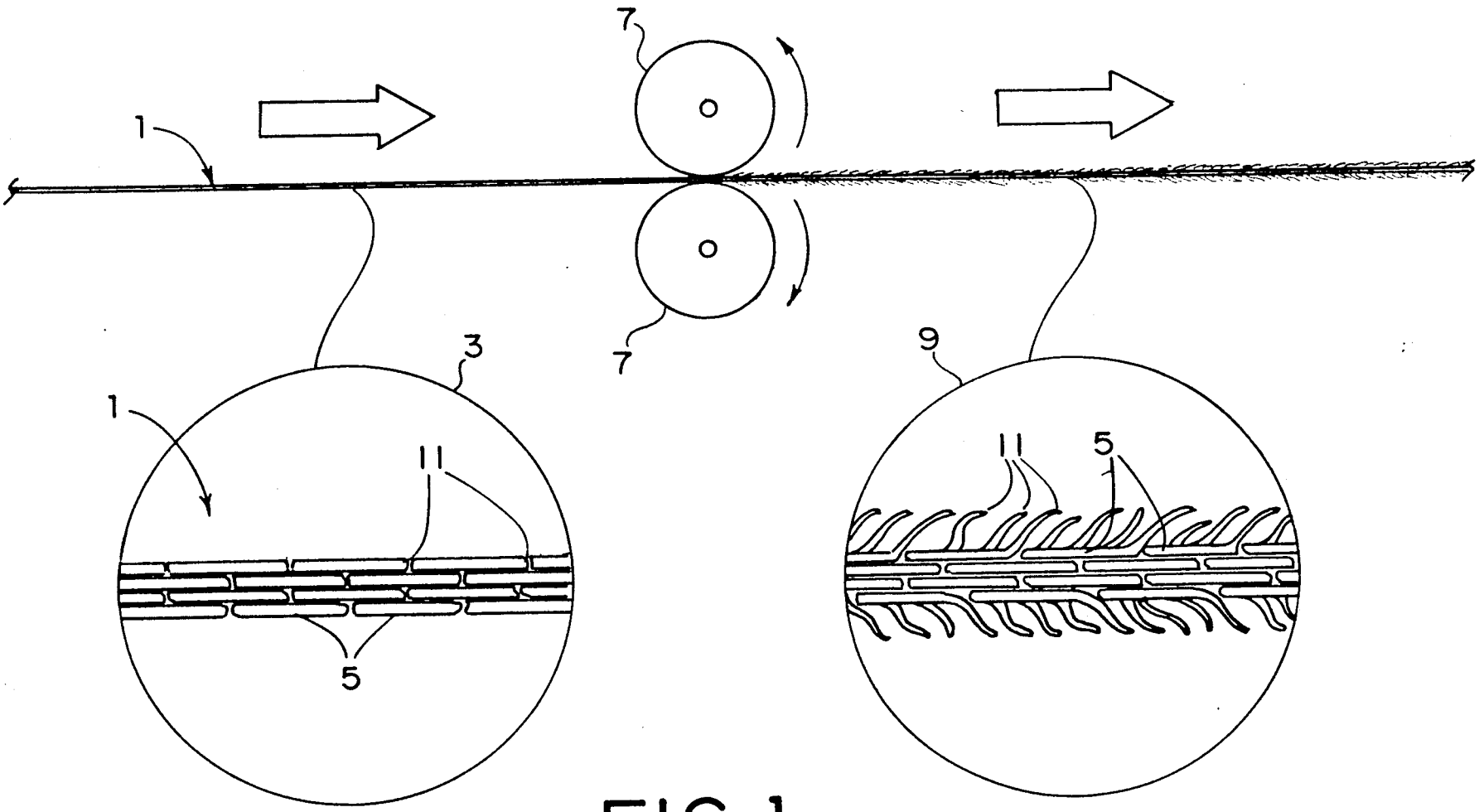
FIG. 1 shows a schematic view of the staple yarn brushing step including therein the staple yarn structure.

FIG. 1 depicts a schematic of an exempiary brushing step performed on a core-spun fiber staple yarn. As can be seen from the figure, the staple yarn 1 prior to the brushing step has a structure as depicted in the enlarged portion 3. The staple yarn 1 is made up of a plurality of individual fibrils 5 intertwined together. The brushing of the yarn loosens the ends 11 of the individual fibrils 5 such that the ends 11 are broken away from the longitudinal alignment of the staple yarn. Although the figure depicts the brushing step being performed by a pair of abrasive wheels 7 on a yarn under tension, any known abrasive device or method of brushing may be utilized to loosen the ends of the individual fibrils.

After the brushing step, the yarn may be subjected to a high-pressure water jet treatment to further intertwine the loosened ends of the individual fibrils. Intertwining of the loosened ends 11 prevents the fibril ends from becoming aligned again in the axial direction of the staple yarn. As will be understood by those skilled in the art, the high pressure water stream should be of sufficient force and quantity to effectively intertwine the fibril ends without demaging the structural integrity of the yarn.

After the brushing step, the yarn may be coated with a fiber finish which aids in flattening the loosened fibril ends to enhance a subsequent knitting or weaving process. The finish may be applied in any conventional manner, such as immersing a continuous strand of yarn through a tank containing the fabric finish. The fabric finish may be an olefin type polymer or other lubricating type substance. It should be noted that, as described above, the brushing step may be performed after the knitting or weaving step. In this mode, the application of the finish may not be necessary, since the fibril ends of the yarn are not loosened prior to the knitting or weaving step.

Figure 2:
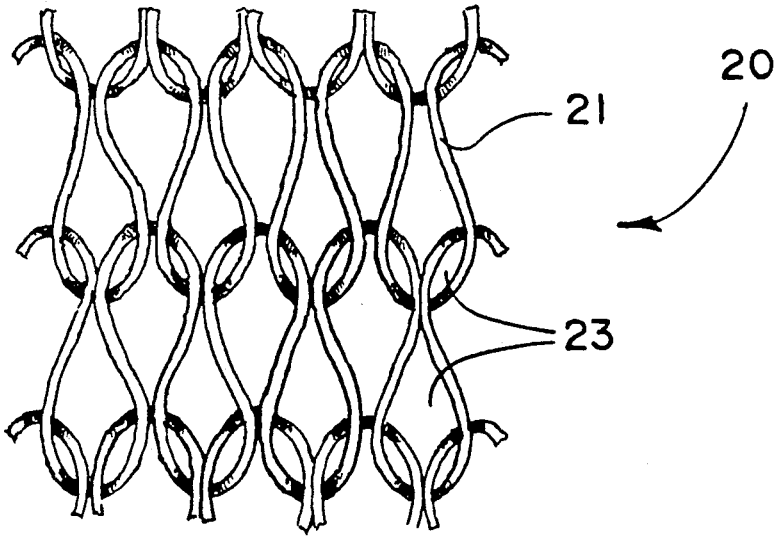
FIG. 2 shows a fabric structure using the prior art method of manufacture.
Figure 3:
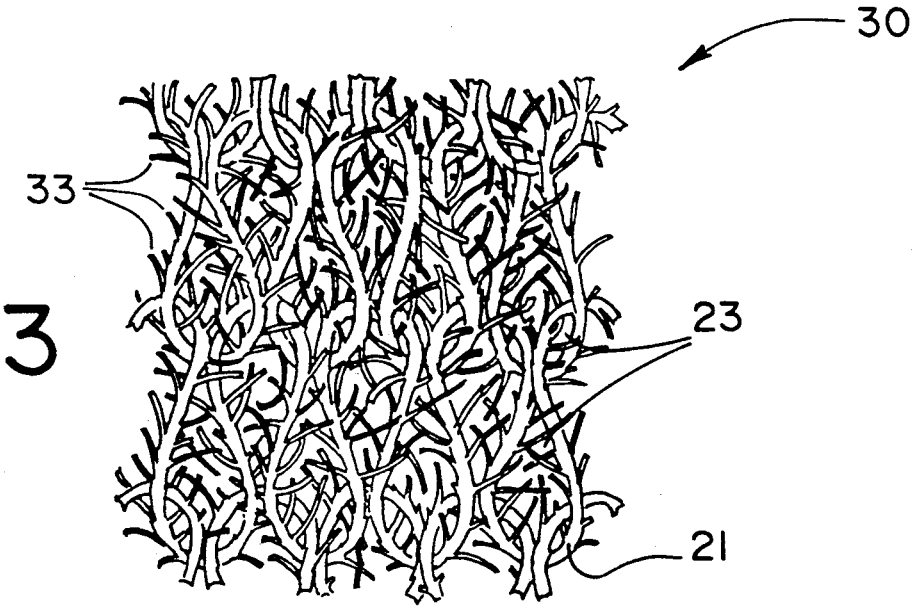
FIG. 3 shows the improved fiber structure using the inventive process.

FIGS. 2 and 3 more clearly illustrate the effect of the brushing step on a knit fabric article. In FIG. 2, a string knit pattern of loops made by the prior art method is designated by the reference numeral 20 and is see to include a plurality of loops 21, each loop having an opening 23 therein. The problem with a string knit puncture-resistant garment having, for example, a polyaramid containing fiber as the puncture-resistant material is that a sharp penetrating object such as a needle may be able to pass through the fabric by the numerous openings 23 created by the loops 21 of the fabric.

FIG. 3 shows the improved string knit fabric pattern of the present invention. The fabric pattern, generally designated by the reference numeral 30, includes a plurality of loops 21*a* having openings 23*a* therein. However, because the yarn includes the loosened fibril ends from a previously applied brushing step as described hereinabove, the loosened fibril ends occupy the openings 23*a* in the loops 21*a*. As a result, sharp penetrating objects that enter the openings 23*a* in the loops 21*a* will engage the fibril ends 33. The fibril ends, by the energy-absorbing characteristics of the fiber itself, will deflect the sharp penetrating objects and resist penetration through the fabric. The loosened fibril ends may directly absorb some of the kinetic energy of the penetrating object as well as deflect the object towards other loosened ends for further energy absorption.

Applicant has discovered that, although different lengths of individual fibrils may be utilized in an exemplary staple yarn, individual fibrils measuring approximately 1.86 inches in length provide improved puncture-resistant characteristics when subject to the above-described brushing step. It should be noted that the string knit pattern as depicted in FIGS. 2 and 3 is exemplary of the various knit or woven patterns that the subject invention may be applicable thereto. Any knit or woven pattern having a plurality of openings similar to that as shown in FIG. 2 may be applicable to the inventive process; in that a yarn utilized in these types of weaves may be subjected to the inventive process to provide improved puncture-resisting characteristics.

Any types of garments or textiles may be utilized with the inventive method. Puncture-resistant gloves may be knitted for use in medical applications, or yarn may be knitted or woven into a cloth for body armor applications. Furthermore, yarns having high tensile strengths, such as KEVLAR®, a polyaramid, DACRON®, polyethylene terephthalate, SPECTRA®, a polyethylene, or polyurethanes, nylon, cotton, fiberglass, polyester or combinations thereof may be utilized in the inventive method.

The following examples better illustrate the improved method of making puncture-resistant garments:

EXAMPLE 1

A KEVLAR® staple yarn is wrapped around LYCRA®, a polyester, to provide a stretch yarn prior to string knitting into gloves. The gloves are then placed over a porcelain hand form and brushed lightly over the fingers with a fine stainless steel wire wheel to render the glove slightly fuzzy. The glove is blown clean with compressed air to remove any loose fibrils. This glove is useful for resisting penetrating needles as the loose fibril ends tend to cover open loops.

EXAMPLE 2

A KEVLAR® fiber staple is wrapped around LYCRA® to provide a stretch yarn. The stretch yarn is held under tension as it is brushed lightly with a fine Stainless Steel wire wheel to render the yarn slightly fuzzy as fibril ends are loosened. The stretch yarn is then coated with a finish to improve string knit capability. The stretch yarn is string knit into gloves and the finish is washed away with suitable solvent to leave tightly bound fibril ends in the loop openings. This glove is useful for resisting needle punctures.

In a further aspect of the present invention, the Applicant has discovered that fibers such as those disclosed hereinabove, when utilized in fabrics having the improved fiber structure as a result of the brushing step to loosen the fibril ends, may be coated with a ceramic or metal particle containing polymeric resin to enhance puncture-resistance. In the inventive method, a continuous filament may be intermittently coated with a mixture of a ceramic or metallic particle and a polymeric resin to provide a thin coating of an abrasive-resistant material over portions of the continuous filament. The coating may be up to 3 microns in thickness with the particular size being less than the total thickness coating. The continuous filament may then be chopped and carded into a staple yarn according to conventional techniques. The staple yarn may then be subjected to the brushing step, as described hereinabove, to produce the loosened end containing fiber structure. The abrasive coating on portions of the fiber increases engagement of a penetrating object with the fiber, thereby improving the puncture-resistance of a garment made from such fiber.

Figure 4:
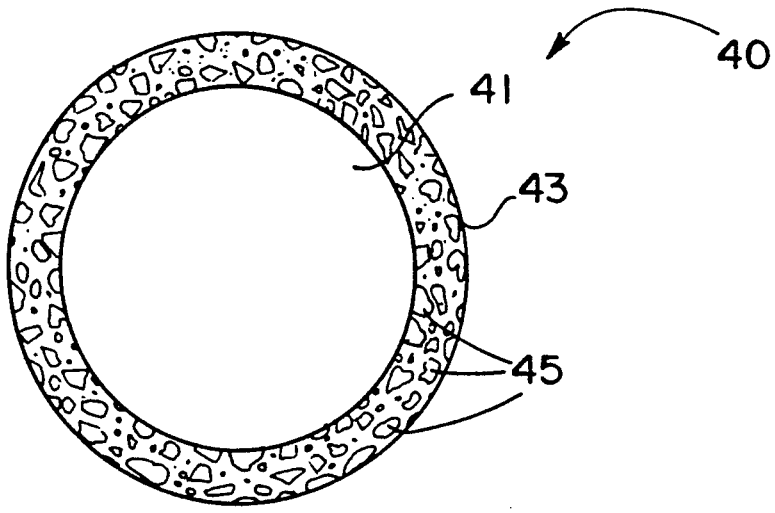
FIG. 4 shows a cross-sectional view of a coated fiber.

FIG. 4 shows a cross-sectional view of a coated fiber. The coated fiber, generally designated by the reference numeral 40, includes the fiber 41 surrounded by the polymeric resin 43. The ceramic or metallic particles embedded in the resin are designated by the reference numeral 45.

Any ceramic or metallic particle that is compatible with a preselected fiber and having abrasive qualities may be used in combination with the polymeric resin. The coating may be up to 3 microns in thickness and may be applied to the fiber in any known manner.

The following Examples better illustrate the use of an abrasive coating step in the inventive method of making puncture-resistant garments:

EXAMPLE 3

A KEVLAR® continuous filament is intermittently coated with 35 vol. %, 0.5 micron diameter alpha-alumina powder mixed with methyl methacrylate diluted to low viscosity in a solvent. The coated portions are cured and the fiber is chopped into staple and carded into yarn. The partially coated KEVLAR® yarn is wrapped around LYCRA® to form a stretch yarn. The stretch yarn is lightly brushed to loosen fibril ends, coated with a heavy finish and string knitted into gloves. After knitting, the glove is washed in a solvent to remove the finish, thereby leaving a glove with tightly bound, abrasively coated fibrils in the loops to engage penetrating objects such as needles.

EXAMPLE 4

This is similar to Example 3, except that the KEVLAR® staple yarn is not wrapped around LYCRA®, but is instead, brushed, finished, and woven into a tight cloth. The cloth is washed to remove the finish and leave the fibrils loose to fill the interstices between yarn. Multiple layers of this cloth are used for soft body armor. This material remains compliant to movement because the fibers are not bonded.

As an alternative to coating the fibers such as those described above with a ceramic or metallic particle containing polymeric resin, the fiber may be coated with a polymer having a high modulus of elasticity such as methacrylates, epoxides or imides. These hard, high modulus polymer coatings distribute instantaneous stress from a penetrating object over large areas of the fibers to increase engagement. These types of coatings may be applied in the same manner as that described in Example 3. Furthermore, the coated filaments may be chopped into staple or used as continuous filament. These polymer coated yarns can be washed with solvent and bonded together to provide greater resistance to pullout and increase fiber warp level. Any fibers that are compatible with these hard high modulus polymers may be used, with the coatings ranging up to 1 micron in thickness.

In a yet further aspect of the present invention, Applicant has discovered that increased puncture-resistance may be obtained by including as part of the individual fibrils that constitute the staple yarn, fibrils having a very high modulus of elasticity and high strength. The staple yarn may comprise from 10 to 50 percent by volume of these high strength fibrils, with the balance selected from the fibers described above as useful in these puncture-resistant applications. The high strength fibrils are shorter in length than the fibrils, 1.88 inches in length, as exemplified above. Typical lengths of these very high modulus fibrils range between 0 to 1 inch. The exact length of the high modulus fibrils may depend upon the particular application of the specific fabric. For example, a fabric having a string knit structure where the fabric movement will tend to be sharper would require shorter length fibrils. A fabric having a simple woven structure, wherein movement of the fabric would not include sharp creases and folds, may utilize fibrils of longer lengths. Examples of very high modulus fibers include graphite or silicon carbide. Of course, any very high modulus fibers that are compatible with the fiber intended to be used as the staple yarn may be utilized. Once the yarn is made with the combination of the very high modulus fibrils and a typical puncture-resistant fiber material, the yarn may be utilized as described in any of the above-mentioned methods, including the brushing step as well as the various coating steps.

In a further aspect of the inventive process, wherein an improved fiber structure is provided which increases the engagement of the fiber with a contacting surface, Applicant has discovered that the improved fiber structure may also be used for treatment purposes. By coating the fiber structure with a disinfecting or pharmaceutical treating agent in varying concentrations, the fiber structure may be used to disinfect penetrating objects, protect skin with mild antibiotics, or apply pharmaceuticals for topical absorption. In this aspect of the invention, a stretch yarn may be produced by wrapping a fiber such as KEVLAR®, nylon, NOMEX®, polyethylene, polyester or cotton around a stretch polyester. These stretch yarns typically contain 3-5% stretch polyester and 95-97% fiber, such as KEVLAR® or the like. When string knitted into a glove, gauntlet, stocking, or the like, the garment conforms to the contour of the body regardless of movement. When these stretch yarns are worn over bare skin, the garment maintains intimate contact therewith. The yarn, after being string knit into a garment, may then be coated with a disinfecting or pharmaceutical treating agent. Alternatively, the yarn may first be coated with the treating agent and then string knit or woven into a particular garment. It should be noted that the brushing step, as described hereinabove, which produces the loosened fibril ends, may be performed on the yarn either before or after the treating agent coating step. Including the brushing step with the coating step provides improved contact between the garment and an engaging surface as a result of the increased surface area due to the loosened end structure of the garment.

In puncture-resistant garment applications, a fabric including the loosened fibril end structure and a disinfecting agent coating provides a structure that not only prevents the penetration of sharp objects passing through the fabric, but also permits the disinfecting agent to contact the sharp object. This contact permits any fluids or the like on the surface of the sharp penetrating object to be disinfected, thereby reducing the risk of transmission of high risk diseases, such as Acquired Immune Deficiency Syndrome, hepatitis, or the like to a user of the garment.

In medicinal treating applications, a pharmaceutical agent may be utilized in combination with the improved fiber structure as a treating agent. In this mode, the fabric having the loosened ends provides a more intimate contact between the pharmaceutical coating thereon and an individual's skin. A yarn coated with antibiotics or other drugs and knitted into gloves and other garments can be used to treat dermatology patients, burn patients, and others benefiting from occlusive dressings. A yarn coated with pharmaceuticals such as hydrocortisone can be used to make gloves or the like for treating chronic skin diseases. In each case, the conforming glove maintains proximity to an individual's skin such that the treating drug is in constant contact with the area requiring treatment.

Any of the types of fibers described hereinabove, whether they be the high strength polymeric type, conventional fabrics or combinations of both, may be utilized in this aspect of the inventive method. Any disinfecting and pharmaceutical agents that are compatible with the fibers listed hereinabove along with effective concentrations thereof may be utilized in the inventive method. Furthermore, any known conventional means of coating these types of disinfecting or pharmaceutical agents on fibers may be utilized.

The following Examples illustrate different types of fibers in combination with pharmaceutical treating or disinfecting agents. It should be noted that the yarns described in the following Examples may include the brushing step as described hereinabove, either before or after the particular coating is applied. Additionally, the brushing step may be applied either before or after the garment is knit or woven.

Examples 5 and 6 illustrate the use of a pharmaceutical treating agent in combination with a particular fiber, with Examples 7-11 showing the use of a disinfecting agent in combination with a preselected fiber.

EXAMPLE 5

Cotton yarn is mixed with corespun polyester and string knitted into a glove. The glove is immersed in an ultrasonic bath containing 0.1% betamethasone valerate (corticosteroid) in 10% polyethylene glycol 1000 monocetyl ether, 10% mineral oil, 47.5% isopropyl alcohol, and water which is pH adjusted to approximately 4.7 with sodium hydroxide and dried. Betamethasone valerate coats the surfaces of the yarn fibrils. The glove is then used as an occlusive dressing for dermatitis.

EXAMPLE 6

Cotton yarn is mixed with corespun polyester and string knitted into a glove. The glove is radiation sterilized to reduce bioburden, then immersed in an ultrasonic bath containing 0.01% neomycin in water. The glove is dried, packaged in peel-back packages, and sterilized. This glove is used to prevent infection of burn patients.

EXAMPLE 7

KEVLAR® yarn is immersed in a circulating bath containing 10% 1-ethenyl-2-pyrrolidinone homopolymer compound with iodine or 1-vinyl-2-pyrrolidinone polymers in an iodine complex in water for thirty seconds at room temperature and air dried. The yarn is then string knitted into protective gloves for police officers handling drug paraphernalia.

EXAMPLE 8

KEVLAR ® yarn is knitted into gloves. The finished glove is immersed in an ultrasonic bath containing 10% solution of 1-ethenyl-2-pyrrolidinone homopolymer compound with iodine or 1-vinyl-2-pyrrolidinone polymers in an iodine complex in methanol for thirty seconds to one minute duration at room temperature and air dried. A disinfectant film covers the fibers in the glove. Needle penetration of a glove finger displaces fibrils as they rub against the needle. Disinfectant on the fiber surface disperses into any liquids containing water, such as blood on the needle. The potentially infective needle is thus disinfected.

EXAMPLE 9

KEVLAR ® yarn is normally made with finishes to facilitate knitting or weaving. Small amounts of relatively inert biocide such as Dowicide 1 are mixed with the fiber to prevent mildew of the damp yarn after washing. Mildew causes discoloration. Disinfectants such as 1-ethenyl-2-pyrrolidinone homopolymer with iodine or 1-vinyl-2-pyrrolidinone polymers in iodine complex are mixed with the surface finishes in concentrations up to 50% by volume. The yarn is then knitted into gloves, gauntlets, and/or aprons. If a needle passes through a glove or other garment, it is exposed to disinfectant released by fluids on the needle.

EXAMPLE 10

Cotton yarn is bathed in a 10% solution of 1-ethenyl-2-pyrrolidinone homopolymer with iodine or 1-vinyl-2-pyrrolidinone polymers in an iodine complex in water and dried. Polyester yarn is bathed in a 10% solution of 1-ethenyl-2-pyrrolidinone homopolymer with iodine or 1-vinyl-2-pyrrolidinone polymers in an iodine complex in water and dried. Cotton and polyester yarns are blended or co-mingled into 50% cotton/50% polyester yarn. This yarn is then woven into domestic textiles such as sheets, pillowcases, and upholstery. These textiles are useful for emergency medical supplies (military, police, or paramedic), and for public facilities like airlines.

EXAMPLE 11

Nylon yarn is finished with a 50/50 mixture of "finish" and disinfectant as in Example 9. The yarn is knitted into gloves for medical technicians and police.

The inventive method provides improvements over prior art methods in that an improved fiber structure is produced which facilitates contact between the fiber structure and a contacting surface. In a first aspect, the improved fiber structure provides increased resistance to sharp penetrating objects in puncture-resistant garment applications. Additionally, the improved fiber structure may be utilized in puncture-resistant garments to not only resist penetration by sharp objects, but provide a disinfecting treatment to the object during penetration. Additionally, the inventive method may be utilized in pharmaceutical treating applications, wherein the improved fiber structure increases and maintains contact between the pharmaceutical treating agent and a skin condition.

As such, an invention has been disclosed in terms of preferred embodiments thereof which fulfill each and every one of the objects of the invention as set forth hereinabove and provides a new and improved method of making puncture-resistant garments of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. In the method of making garments having improved puncture resistance against sharp penetrating objects including the steps of providing a fiber having puncture-resistant properties, producing a plurality of individual fibrils from said fiber, forming said fibrils into a yarn and manufacturing a puncture-resistant garment from said yarn, the improvement comprising the step of brushing said yarn with an abrasive device to loosen the ends of said fibrils, said loosened ends of said fibrils providing enhanced puncture-resistance by crossing and covering holes between yarns and intertwining, thereby providing increased surface area to engage a sharp penetrating object.

2. The method of claim 1, wherein said fiber is selected from the group consisting of polyaramids, polyesters, polyethylenes, cotton, nylon, scleroproteins, polyurethanes, fiberglass or combinations thereof.

3. The method of claim 1, including performing said brushing step on said yarn prior to said step of manufacturing said puncture-resistant garment.

4. The method of claim 1, including performing said brushing step on said yarn after said manufacturing step.

5. The method of claim 1, further comprising, after said brushing step, subjecting said yarn to a high-pressure fluid stream to intertwine said loosened ends of said fibrils.

6. The method of claim 1, further comprising the step of coating said fiber with an abrasive material to further enhance engagement of a sharp penetrating object by said fibrils.

7. The method of claim 6, wherein said abrasive material further comprises ceramic particles dispersed in a polymeric resin.

8. The method of claim 7, wherein said coating step further comprises immersing said fiber in a bath containing said ceramic particles dispersed in said polymeric resin.

9. The method of claim 1, further comprising the step of coating said fiber with a polymer having a high modulus of elasticity, said coated fiber enhancing puncture-resistance by distributing an instantaneous stress from a penetrating object over a large surface area of a said fiber.

10. The method of claim 1, wherein said polymer is selected from the group consisting of epoxides, imides and methacrylates.

11. The method of claim 1, further comprising the step of coating said yarn with a disinfecting agent, said coated yarn providing a disinfecting effect on infectious fluids associated with a said sharp penetrating object.

12. The method of claim 11, wherein said coating step further comprises, after said yarn is manufactured into a said puncture-resistant garment, immersing said garment into an ultrasonic bath containing a said disinfecting agent.

13. The method of claim 11, wherein said disinfecting agent is selected from the group consisting of a 10% solution of 1-ethenyl-2-pyrrolidinone homopolymer with iodine and 1-vinyl-2-pyrrolidinone polymers in an iodine complex.

14. In the method of making garments having improved medical treatment properties including the step of providing a fiber, producing a plurality of individual fibrils from said fiber, forming said fibrils into a yarn and manufacturing a garment from said yarn, the improvement comprising the step of:

(i) brushing said yarn with an abrasive device to loosen the ends of said fibrils; and (ii) coating said brushed yarn with a pharmaceutical agent, (iii) whereby said coated fibril containing garment provides an improved medical treatment by increased contact between said pharmaceutical agent coated fibrils and an adjacent skin condition when said garment is worn over a said skin condition.

15. The method of claim 14, wherein said pharmaceutical treating agent is selected from the group consisting of steroids and antibiotics.

16. The method of making a puncture-resistant garment including the steps of:

(i) providing a first fibril having a high strength and a high modulus of elasticity, said first fibril having a length up to approximately 1.86 inches;

(ii) providing a second fibril having an ultra-high modulus of elasticity, said second fibril having a length up to approximately 1 inch;

(iii) forming a yarn from said first and said second fibrils, said yarn comprising between 10–50 percent by volume of said second fibril and the balance said first fibril; and (iv) forming a puncture-resistant garment from said yarn, said puncture-resistant garment having improved puncture resistance by said second fibrils having increased capability to absorb and deflect loads from penetrating objects.

17. The method of claim 16, wherein said first fibrils are formed from fibers selected from the group consisting of polyaramids, polyethylenes, polyurethanes, cotton, nylon, fiberglass, scleroproteins, polyesters and combinations thereof.

18. The method of claim 16, wherein said second fibrils are formed from fibers selected from the group consisting of graphite and silicon carbide.

19. An improved fabric pattern for puncture-resistant and medicinal treatment comprising:

(i) a yarn made from a fiber, said yarn further comprising a plurality of individual fibrils, said yarn having at least a portion of the ends of said individual fibrils loosened by brushing such that said loosened ends project away from the longitudinal axis of said yarn;

(ii) said yarn being woven into a plurality of interconnected loops, each loop forming an opening therein, said loosened ends of said fibrils occupying said openings, (iii) whereby said loosened ends of said fibrils enhance engagement of sharp penetrating objects passing through said openings and deter penetration through a garment having said improved fabric pattern and providing increased contact between a garment having said improved fabric pattern and a skin condition requiring medical treatment.

20. The invention of claim 19, wherein said fiber is selected from the group consisting of polyaramids, polyethylenes, polyesters, cotton, nylon, fiberglass, scleroproteins, polyurethanes and combinations thereof.

21. The invention of claim 19, wherein said fibrils include a coating of an abrasive material thereon to further enhance said fibrils engaging a said sharp penetrating object.

22. The invention of claim 21, wherein said coating further comprises ceramic particles dispersed in a polymeric resin.

23. The invention of claim 19, wherein said fibrils include a coating of a disinfecting agent thereon to provide a disinfecting effect on a said sharp penetrating object having infectious fluid thereon.

24. The invention of claim 21, wherein said disinfecting agent is selected from the group consisting of a 10% solution of 1-ethenyl-2-pyrrolidinone homopolymer with iodine and 1-vinyl-2-pyrrolidinone polymers in an iodine complex.

25. The invention of claim 19, wherein said fibrils include a coating of a pharmaceutical treating agent thereon, said coated fibrils providing an improved pharmaceutical treating effect by increased contact between a said garment containing loosened ends of said coated fibrils and a skin condition covered by a said garment.

26. The invention of claim 25, wherein said coating is selected from the group consisting of steroids and antibiotics.

27. The product produced by the method of claim 1.

28. The product produced by the method of claim 6.

29. The product produced by the method of claim 9.

30. The product produced by the method of claim 11.

31. The product produced by the method of claim 14.

32. The product produced by the method of claim 16.

* * * * *